US008702026B2

(12) United States Patent
Evans et al.

(10) Patent No.: US 8,702,026 B2
(45) Date of Patent: Apr. 22, 2014

(54) HOSE REEL, AND METHOD OF USING THEREOF

(75) Inventors: Richard Douglas Evans, Rishon LeZion (IL); Avraham Maltz, Tel Aviv (IL)

(73) Assignee: Keter Plastic Ltd., Herzelia (IL)

( * ) Notice: Subject to any disclaimer, the term of this patent is extended or adjusted under 35 U.S.C. 154(b) by 176 days.

(21) Appl. No.: 13/067,688

(22) Filed: Jun. 21, 2011

(65) Prior Publication Data

US 2012/0325952 A1 Dec. 27, 2012

(51) Int. Cl.
*B65H 75/30* (2006.01)

(52) U.S. Cl.
USPC ..... 242/395; 242/578; 242/578.3

(58) Field of Classification Search
USPC ..... 242/395, 395.1, 398, 405.3, 578, 242/578.1–578.3
See application file for complete search history.

(56) References Cited

U.S. PATENT DOCUMENTS

| | | | | |
|---|---|---|---|---|
| 2,777,646 | A * | 1/1957 | Manahan | 242/577.1 |
| 4,732,345 | A * | 3/1988 | Golden | 242/539 |
| 5,425,391 | A * | 6/1995 | Tisbo et al. | 137/15.01 |
| 6,978,797 | B2 * | 12/2005 | Nagler et al. | 137/355.27 |

* cited by examiner

*Primary Examiner* — Sang Kim

(74) *Attorney, Agent, or Firm* — Eitan, Mehulal & Sadot

(57) ABSTRACT

The present invention includes an expandable hose reel, which may include: a housing defined by at least one or more base members; a spool rotatably disposed within the housing, wherein the spool is adapted to connect to a flexible hose; a winding mechanism to rotate the spool and to coil the flexible hose around the spool; and an expansion mechanism to modify a length of the spool.

21 Claims, 21 Drawing Sheets

HOSE REEL, AND METHOD OF USING THEREOF

FIELD

The present invention is related to the field of hose reels for winding of flexible hoses.

BACKGROUND

A hose may be used for various purposes, for example, for watering a garden or a yard, for putting out a fire, as a game for children in summer time, to fill a remote container of water, to transfer water or other liquid(s) from a first point (e.g., a faucet) to a second point (e.g., a container), or the like.

Some hoses may be flexible, and may be made, for example, from rubber or other elastic material(s). Some hoses may be long, for example, and may reach several meters in length.

A hose reel may be used in order to facilitate storage of a long, flexible hose, when the hose is not in use. For example, a crank or handle may be rotated by a user in order to cause the flexible hose to rotate around a central spool of the hose reel, thereby winding or coiling the flexible hose around the spool and forming a spiral or coiled entity which may be stored more efficiently than a stretched or unfolded flexible hose.

SUMMARY

The present invention may include a hose reel having a rotatable spool disposed within a housing or a support frame, such that the length of the spool may be increased and decreased by using an expansion mechanism of the spool.

In accordance with the present invention, for example, a hose reel may include: a housing defined by at least one or more base members; a spool rotatably disposed within the housing, wherein the spool is adapted to connect to a flexible hose; a winding mechanism to rotate the spool and to coil the flexible hose around the spool; and an expansion mechanism to modify a length of the spool.

In accordance with the present invention, for example, the expansion mechanism may include a telescopic mechanism having two or more nested tubes of gradually-decreasing diameters.

In accordance with the present invention, for example, the expansion mechanism may include one or more materials able to stretch in length upon application of force.

In accordance with the present invention, for example, the expansion mechanism may include a self-expanding mechanism to self-expand in response to an increase in volume of the flexible hose coiled around the spool.

In accordance with the present invention, for example, the winding mechanism may include a handle; and a length of the expansion mechanism is to expand in response to a pulling of the handle away from the spool.

In accordance with the present invention, for example, a length of the expansion mechanism is to gradually expand during coiling of the flexible hose around the spool.

In accordance with the present invention, for example, the housing may include one or more expansion mechanisms to expand a width of the housing in response to an increase in volume of the flexible hose coiled around the spool.

In accordance with the present invention, for example, the housing may include a support frame defined by first and second sides; the expansion mechanism is to increase a distance between the first and second sides of the support frame in response to at least one of: an increase in volume of the flexible hose coiled around the spool; and a pulling of a handle of the winding mechanism in an outwardly direction away from the spool.

In accordance with the present invention, for example, the one or more base members of the housing may include one or more, respective, expansion mechanisms to expand a length of the one or more base members of the housing.

In accordance with the present invention, for example, the housing may include a top member usable as a carrying handle, wherein the top member may include an expansion mechanism to expand a length of a top member of the housing.

In accordance with the present invention, for example, the spool may include a connector to detachably attach the flexible hose to the spool.

In accordance with the present invention, for example, a lower part of the hose reel may include two or more wheels to allow manual wheeling of the hose reel.

In accordance with the present invention, for example, the winding mechanism may include a fixed non-folding handle.

In accordance with the present invention, for example, the winding mechanism may include a multiple-position handle able to pivot from a raised position to a lowered position.

In accordance with the present invention, for example, the winding mechanism may include an electric motor.

In accordance with the present invention, for example, a width of the housing is modifiable.

In accordance with the present invention, for example, the length of the spool is modifiable.

In accordance with the present invention, for example, at least the spool and the expansion mechanism are formed of plastic.

In accordance with the present invention, for example, at least the spool and the expansion mechanism are formed of one or more injected plastic materials.

In accordance with the present invention, for example, substantially all components of the hose reel are formed of plastic.

In accordance with the present invention, for example, substantially all components of the hose reel are formed of one or more injected plastic materials.

In accordance with the present invention, for example, the hose reel may include the flexible hose, and the flexible hose may be detachably attached to the spool.

The present invention may provide other and/or additional benefits and/or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

Figure 1A:
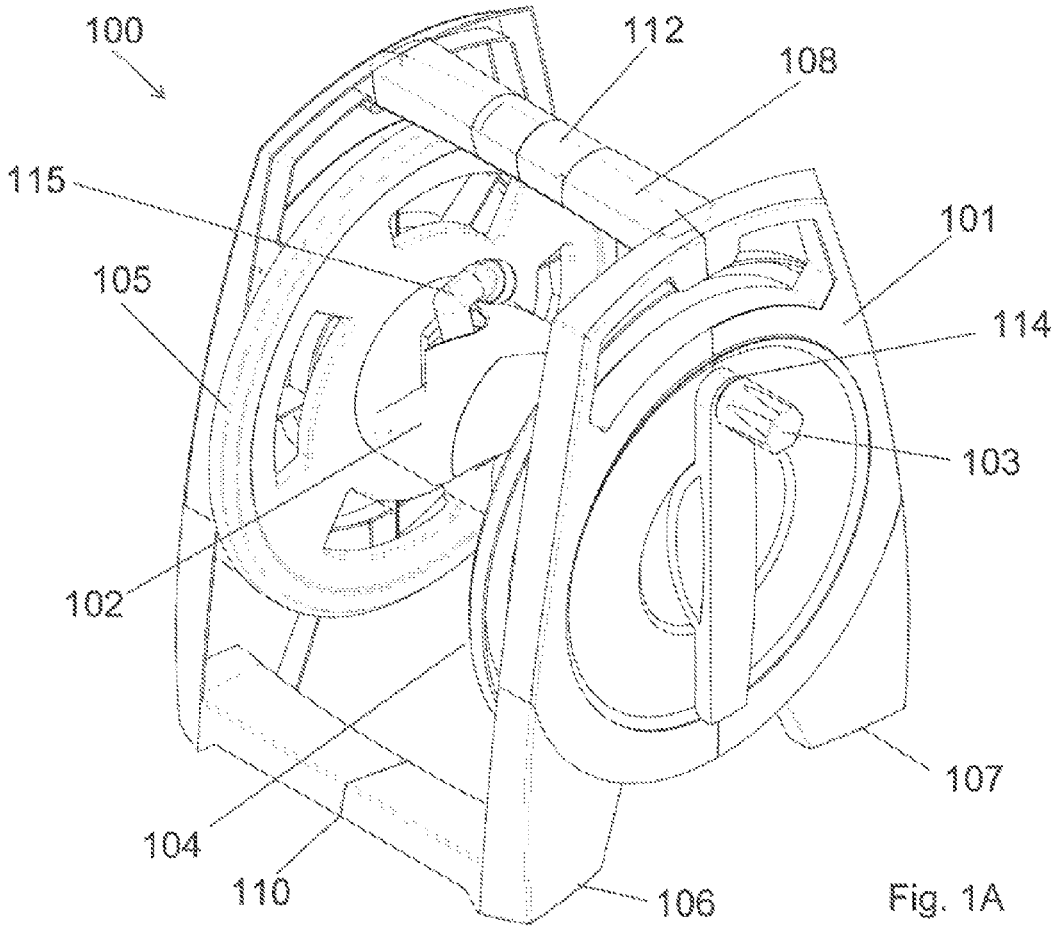
FIG. 1A is a schematic illustration of a perspective view of a hose reel in accordance with the present invention.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Applicants have realized that a hose reel need not have a constant size or a fixed width. Particularly, Applicants have realized that a hose reel may need to be wide when a flexible hose is winded or coiled therein; but that the hose reel may have a reduced width or volume once the flexible hose is removed or is stretched out. Therefore, a hose reel may have a reduced width and/or a reduced volume when the flexible hose is not present therein, or when the flexible hose is entirely or partially stretched out from the hose reel, or when a shorter flexible hose is used in conjunction with the hose reel. A reduced-size or narrower hose reel may require less volume for storage, for example, when being placed on a shelf at a store, or when being shipped or moved.

The present invention may provide other benefits; for example, a reduced-size hose reel or a reduced-width hose reel may be utilized by a user in order to accommodate a relatively short flexible hose. For example, a person may utilize a short flexible hose, of around 3 or 5 meters length, in order to water plants in a balcony; and may thus need a narrower hose reel for coiling such flexible hose. A full-width or expanded-width hose reel may not efficiently fit within such balcony or other constrained space. In accordance with the present invention, a reduced-size or reduced-width hose reel may be used in conjunction with a short flexible hose; whereas an expanded-size or expanded-width hose reel may be used in conjunction with a long hose or a medium-length hose, and may also accommodate a variety of hose lengths between the short hose and the long hose.

In accordance with the present invention, a hose reel may expand horizontally and may increase its volume and size upon winding of a flexible hose therein, or during the process of winding the flexible hose. In contrast, the hose reel may shrink horizontally and may decrease its volume and size once the flexible hose is removed, or during a process in which the flexible hose is being stretched out or removed.

In accordance with the present invention, the hose reel may be able expand and/or may be able to shrink, for example, while the flexible hose is connected to the hose reel; and/or while the flexible hose is disconnected from the hose reel; and/or while the flexible hose is being coiled around a core or spool of the hose reel; and/or while the flexible hose is being retracted or uncoiled from the core or spool of the hose reel.

The horizontal expansion of the hose reel may be triggered, for example, by manual rotation of a handle of the hose reel in a first direction (e.g., clockwise), or by a pull of the handle of the hose reel outwardly. In contrast, shrinkage or size-reduction of the hose reel may be triggered, for example, by manual rotation of the handle of the hose reel in a second direction (e.g., counter-clockwise), or by a push of the handle of the hose reel inwardly. The expansion and shrinkage (or narrowing) may be implemented, for example, using a telescopic mechanism, a male/female mechanism, a mechanism formed of stretchable or shrinkable materials, a ratchet mechanism, a self-expanding mechanism, a user-initiated mechanism, a mechanism triggered by the coiling of the flexible hose, or other suitable mechanism(s).

In accordance with the present invention, the length of a spool of the hose reel may increase or decrease, or may be user-modifiable or user-adjustable. Furthermore, the width of the housing or support frame of the hose reel may increase or decrease, or may be user-modifiable or user-adjustable. These features may be in contrast with conventional hose reels, in which the spool has a fixed length, and in which the housing or support frame has a fixed width.

Figure 1B:
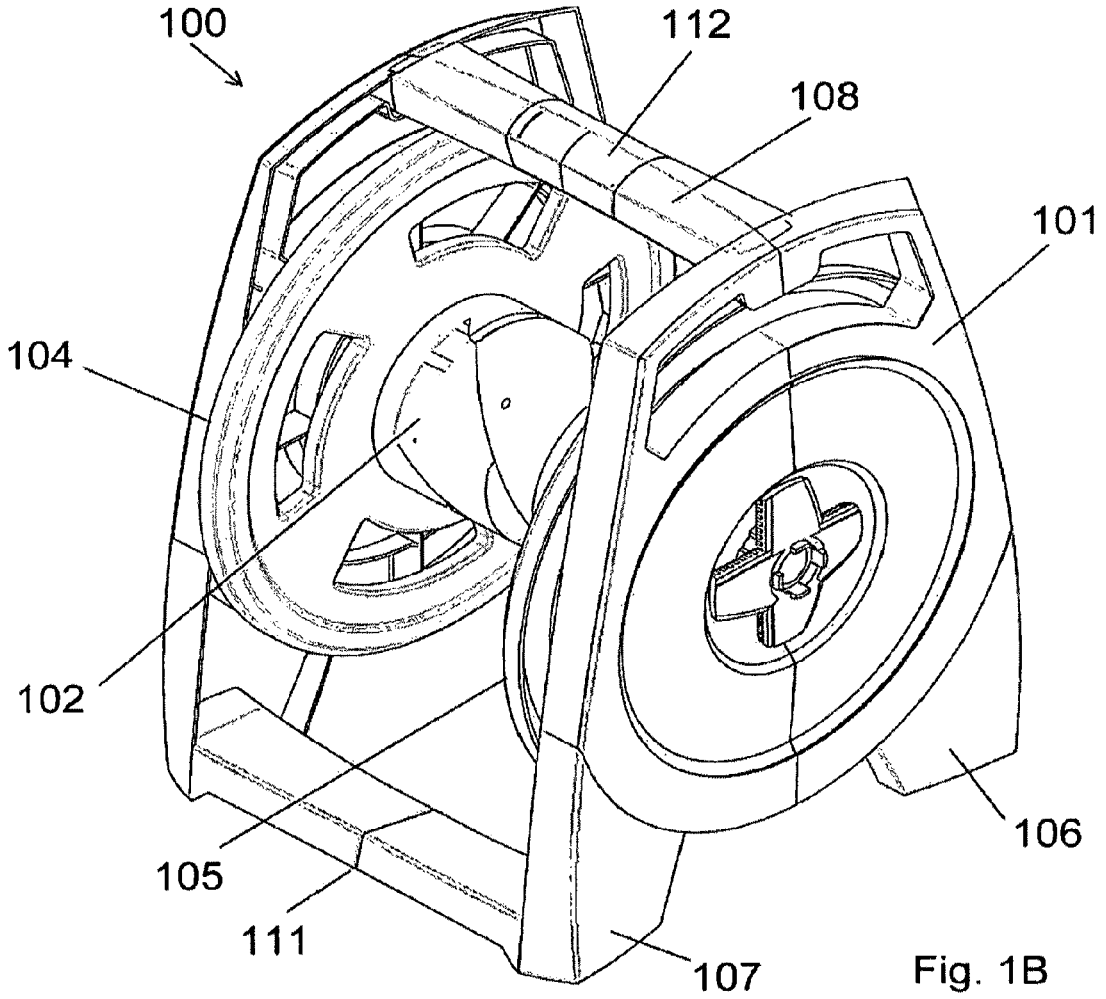
FIG. 1B is a schematic illustration of a side view of the hose reel in a narrow position, in accordance with the present invention.
Figure 1C:
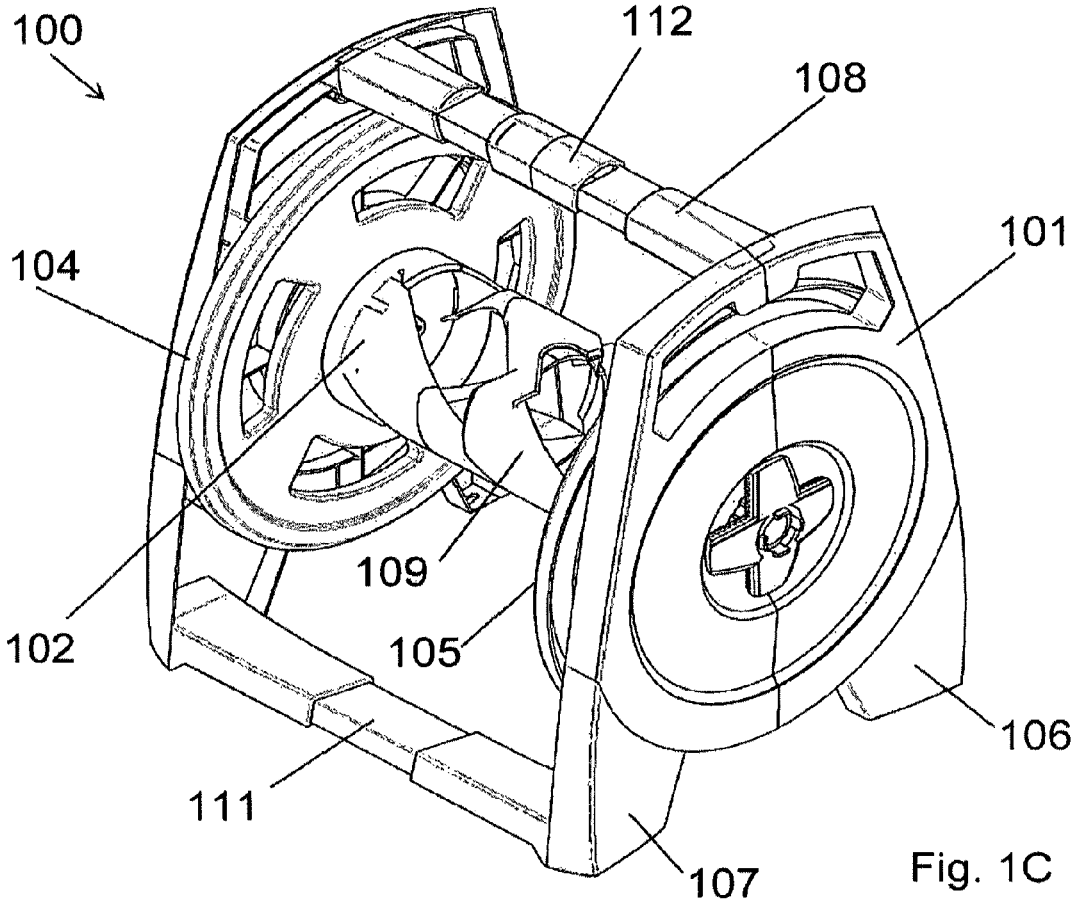
FIG. 1C is a schematic illustration of a side view of the hose reel in an expanded position, in accordance with the present invention.

Reference is made to FIG. 1A, which is a schematic illustration of a perspective view of a hose reel 100 in accordance with the present invention; as well as to FIGS. 1B and 1C, which are schematic illustrations of a side view of the hose reel 100 in a narrow position (FIG. 1B) and in an expanded position (FIG. 1C), in accordance with the present invention.

Hose reel 100 may include, for example, a housing 101, a spool 102, and a handle 103. The housing 101 may be or may include, for example, a frame or assembly or structure capable of supporting or holding the other components of the hose reel 100. Optionally, the housing 101 may be capable of being steadily positioned on a substantially flat surface (e.g., a floor, a table, the ground), for example, without rocking or shaking. The housing 101 may include two (or more) horizontal legs 106-107 or other type of base member(s), to allow the hose reel 100 to firmly stand on a generally flat surface; as well as a horizontal top member 108 which may further be used as a carrying member or a carrying handle, allowing a user to lift the hose reel 100 from the top by holding the top member 108. Optionally, the housing 101 and/or the hose reel 100 may be structured to be stackable and/or nestable, for example, to allow a first hose reel to be stacked on top of a second hose reel; and/or to allow one hose reel to be at least partially nested within another hose reel. This may allow efficient stacking and/or space-saving storage of multiple hose reels, for example, in a store or at the user's location.

The spool 102 may be, for example, a rotatable cylinder or core or drum which may be connected to the handle 103 and which may rotate upon rotation of the handle 103. The handle 103 may be a single-position non-folding handle; or may be a multi-position collapsible handle or crank which may be placed by the user in a lowered (or folded) position or in a raised (or extended) position, by utilizing a folding mechanism 114 allowing the handle 103 to fold or pivot.

Rotation of the handle 103 may cause corresponding rotation of the spool 102 about a common axis of rotation, which may be, for example, generally parallel to a surface on which the hose reel may be placed. Such rotation, in turn, may cause winding of a flexible hose 199 which may be connected to the spool 102. The flexible hose 199 may be detachably connected to the spool 102, by using a hose connector 115 or other connection mechanisms, for example, a clip, a screw, a pair of screws, a pressure-based connector, a male/female connector, a forcible insertion of the flexible hose 199 into a corresponding hole or cavity within the spool 102, or other suitable connection mechanisms.

The flexible hose 199 may be, for example, a water hose, a garden hose, a rubber hose, a hose able to be folded or coiled or spiraled, a hose for transferring water or other liquid(s) from a first point to a second point, a hose for putting off a fire, an air hose, or the like. The flexible hose 199 may be or may include other type(s) of components, for example, elastic hose, elastic member, elastic element, elongated element, elongated member, or the like. The flexible hose 199 may include, for example, a hollow tube or pipe or tubing elements, capable of carrying or transferring or conveying fluid(s) and/or liquid(s) and/or gas(es) from a first location to another location. The flexible hose 199 may be generally cylindrical in shape, or may have a generally circular cross-section or generally oval cross-section. The flexible hose 199 may be formed of, for example, rubber, natural rubber, synthetic rubber, plastic, nylon, polyurethane, polyethylene, Low Density PolyEthylene (LDPE), Linear LDPE (LLDPE), PolyVinyl Chloride (PVC), PolyTetraFluoroEthylene (PTFE) or Teflon, and/or a combination of two or more such materials or other material(s) (e.g., in order to achieve a particular pressure rating or other characteristics). The flexible hose 199 may be non-metallic or may be substantially metal-free, or alternatively, may include metal components (e.g., metal connectors or endings, stainless steel portions, or the like). The flexible hose 199 may optionally include, or may be, an elongated and/or flexible and/or elastic item or article which may not be capable of transferring fluids; for example, a wire, a cable, an electric cable or wire, a chain, a rope, a string, a cord, a power cord, and/or other element which may be elongated and which may be subject to bending, coiling, wrapping, reeling, winding, folding, spiraling, or otherwise morphing or modifying its dimension(s). Such elements or components or items, even if not being a hose, may be regarded as equivalents and may be included in the terms "hose" or "flexible hose" as used herein; and the present invention may be used in conjunction with such types of elements, components or items.

The hose reel 100 may include one or more components or mechanisms which may allow modification of the size or length or width of one or more components of the hose reel 100, for example, by allowing expansion and/or shrinkage of width of such component(s) of the hose reel 100. For example, the spool 102 may include a spool expansion mechanism 109; and/or the legs 106-107 may include lower expansion mechanisms 110-111, respectively; and/or the top member 108 may include an upper expansion mechanism 112. The expansion mechanisms 109-112 may be triggered by a user of the hose reel 100, by coiling of the flexible hose 199 around the spool 102, by pulling of the handle 103 away from the spool 102, and/or by other triggering events or processes.

Optionally, the hose reel 100 may include two thin plates or disks 104-105 located on internal sides of the housing 101, such that the spool 102 may be rotatably disposed between the two disks 104-105. This may allow separation between the flexible hose 199 being winded and the housing 101, thereby facilitating the winding of the flexible hose 199 and preventing possible rubbing of the flexible hose 199 against the housing 101 or other components of the hose reel 100.

In accordance with the present invention, the hose reel 100 may horizontally expand upon or during winding of the flexible hose 199, and/or upon demand of a user operating the hose reel 100. For example, the user may pull the handle 103 outwards, horizontally and away from the spool 102, thereby causing or triggering horizontal expansion of the spool 102, as well as horizontal expansion of the housing 102. For example, the spool 102 may expand by utilizing the spool expansion mechanism 109; the legs 106-107 may expand by utilizing lower expansion mechanisms 110-111, respectively; and the top member 108 may expand by utilizing the upper expansion mechanism 112.

The expansion mechanisms 109-112 may be of a common type, or alternatively, may be of two or more different types. For example, the expansion mechanisms 109-112 may include a telescopic mechanism in which a set of two or more cylinders (or non-cylindrical bodies, e.g., cubes or boxes) are able to be inserted in series one into another, or, a series of tubes of progressively smaller diameters are nested within each other (e.g., ranging from a largest sleeve known as a barrel, through smaller sleeves known as stages, to a smallest member known as a plunger); a male-female mechanism in which a pin or protrusion is able to be inserted into a corresponding tunnel; an expansion mechanism based on characteristics of elasticity or flexibility of one or more materials which may allow a member formed thereof to stretch or to shrink in response to application of pressure or force; a screw and threading mechanism in which a screw-shaped member is able to rotate within a corresponding threading member and may thereby expand or shrink the combined length of the screw and threading mechanism; a ratchet mechanism in which one or more members may move relative to a set of teeth, and may be trapped between two adjacent teeth until released therefrom; a mechanism in which a horizontal rod is able to horizontally travel within a larger horizontal channel or tunnel; or other suitable types of expansion, stretching, shrinking, collapsing and/or narrowing mechanisms.

Optionally, the hose reel 100 may horizontally self-expand as the flexible hose 199 is being winded or coiled. For example, during the winding process, the flexible hose 199 may occupy a gradually-increasing horizontal space or width or volume, and may push outwardly one or more of the inner sides of the housing 101, thereby causing expansion of one or more of the expansion mechanisms 109-112 and, in turn, causing the gradual expansion of the entire hose reel 100. Optionally, stretching of the flexible hose 199, or partial or complete removal of the flexible hose 199 from the hose reel 100, may eliminate or may decrease such pressure applied on the inner sides of the housing 101, and the housing 101 may thus shrink back and assume its original unexpanded properties. Optionally, a user may slightly lift the hose reel 100 from the ground (e.g., by holding the top member 108), in order to reduce or eliminate friction between the legs 106-107 and the ground (or other surface), thereby allowing a smoother expansion or width modification of the hose reel 100.

The expansion of the hose reel 100 may be triggered (e.g., on demand, or abruptly, and not gradually) by a manual pull outward of the handle 103, which may be pulled by a user away from the spool 102. Additionally or alternatively, such expansion may be triggered (e.g., gradually or slowly) by the winding process of the flexible hose 199 as such hose gains width and volume within the housing 101.

The narrowing or shrinking of the hose reel 100 may be triggered by a manual push inward of the handle 103 towards the spool 102. Additionally or alternatively, such narrowing or shrinking may be triggered by a process of stretching the flexible hose 199 away from the hose reel 100, or by releasing or removing the flexible hose (partially or entirely) from the hose reel 100, thereby decreasing the width and volume that the coiled flexible hose 199 occupies within the housing 101 and allowing one or more of the expansion mechanisms 109-112 to return to their original non-expanded position(s).

Figure 2:
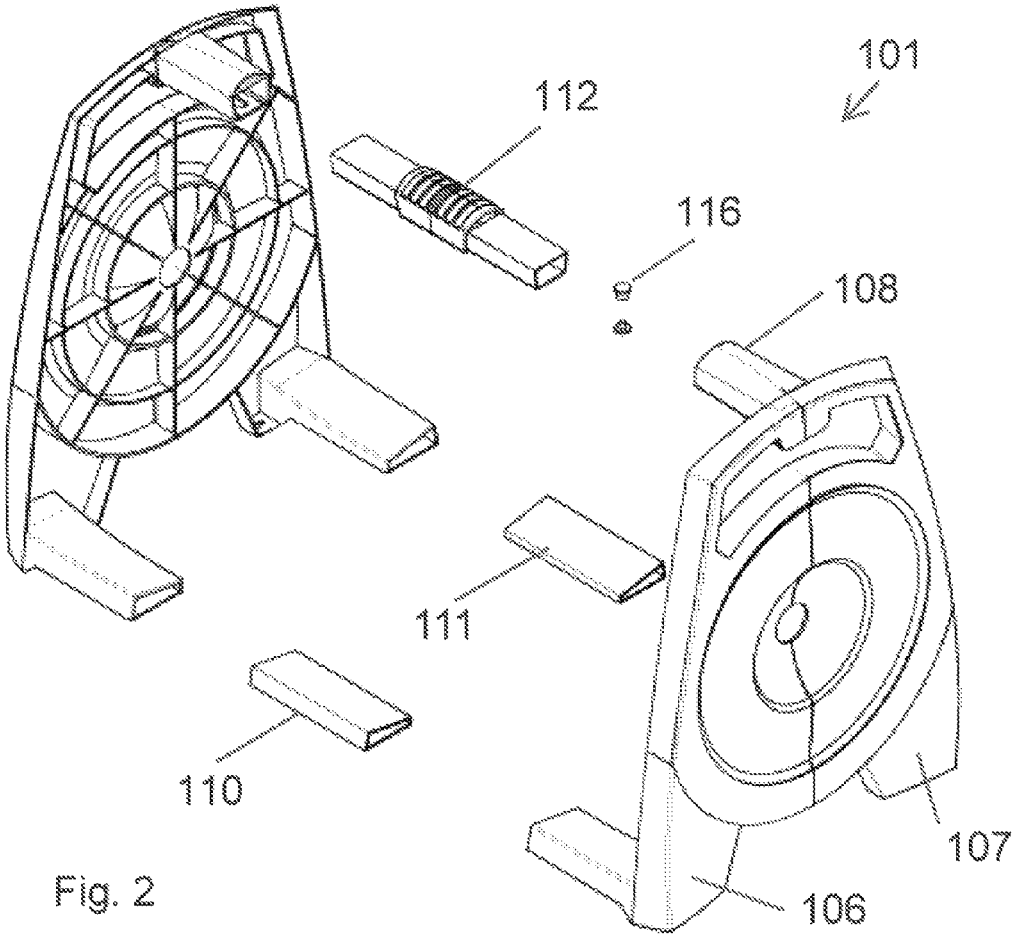
FIG. 2 is a schematic illustration of an exploded view of a housing of the hose reel, in accordance with the present invention.

Reference is made to FIG. 2, which is a schematic illustration of an exploded view of the housing 101 in accordance with the present invention. FIG. 2 shows in greater detail the components of housing 101, including the legs 106-107, the expansion mechanisms 109-110 of the legs 106-107, the top member 108, the expansion mechanism 112 of the top member 108, as well as connecting elements 116 (e.g., nuts, bolts, screws, nails, bonding elements) which may connect between adjacent components of housing 101.

Figure 3:
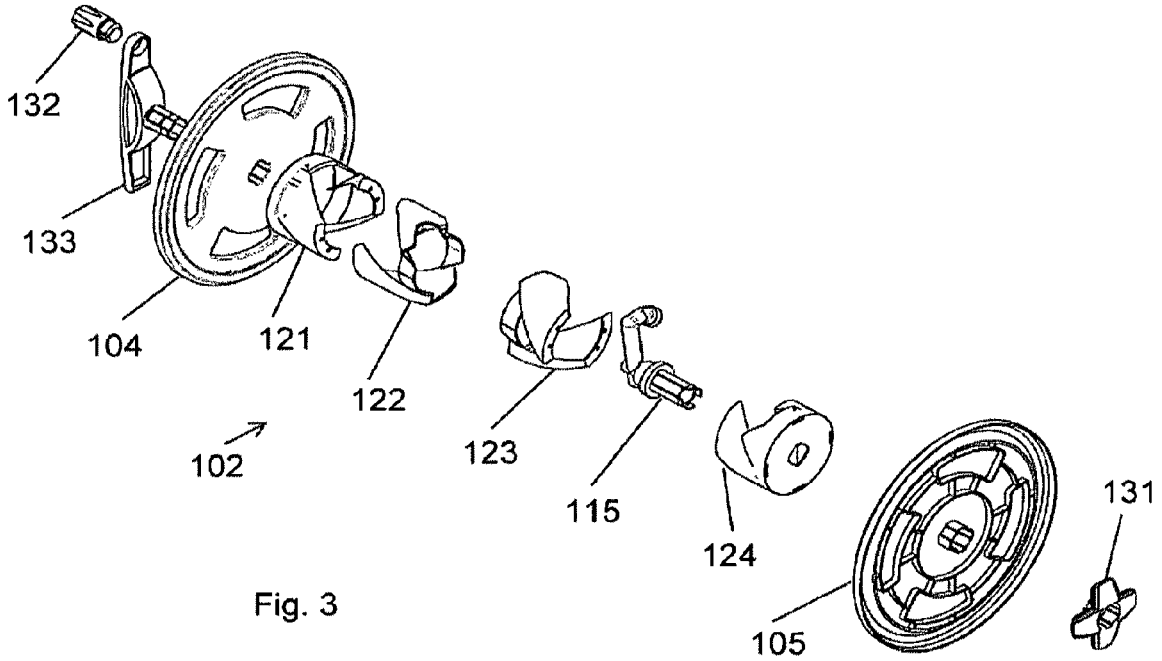
FIG. 3 is a schematic illustration of an exploded view of a spool of the hose reel, in accordance with the present invention.

Reference is made to FIG. 3, which is a schematic illustration of an exploded view of the spool 102 in accordance with the present invention. FIG. 3 shows in greater detail the components of spool 102, including the hose connector 115 as well as stretchable sub-units 121-124 of the spool 102. Four stretchable sub-units 121-124 are shown, for demonstrative purposes; other number of sub-units may be used; and all of the sub-units, or some of them, or one of them, may be stretchable or otherwise able to expand and/o shrink. Further shown in FIG. 3 are handle components, for example, a crank 132 which may be generally parallel to the spool 102, and a handle base 133 which may be generally perpendicular to the spool 102. One end of the spool 102 may end with the handle base 133; whereas the other end of the spool 102 may end with a cross-shaped (or other suitable shape) lead or terminator 131.

Figure 4A:
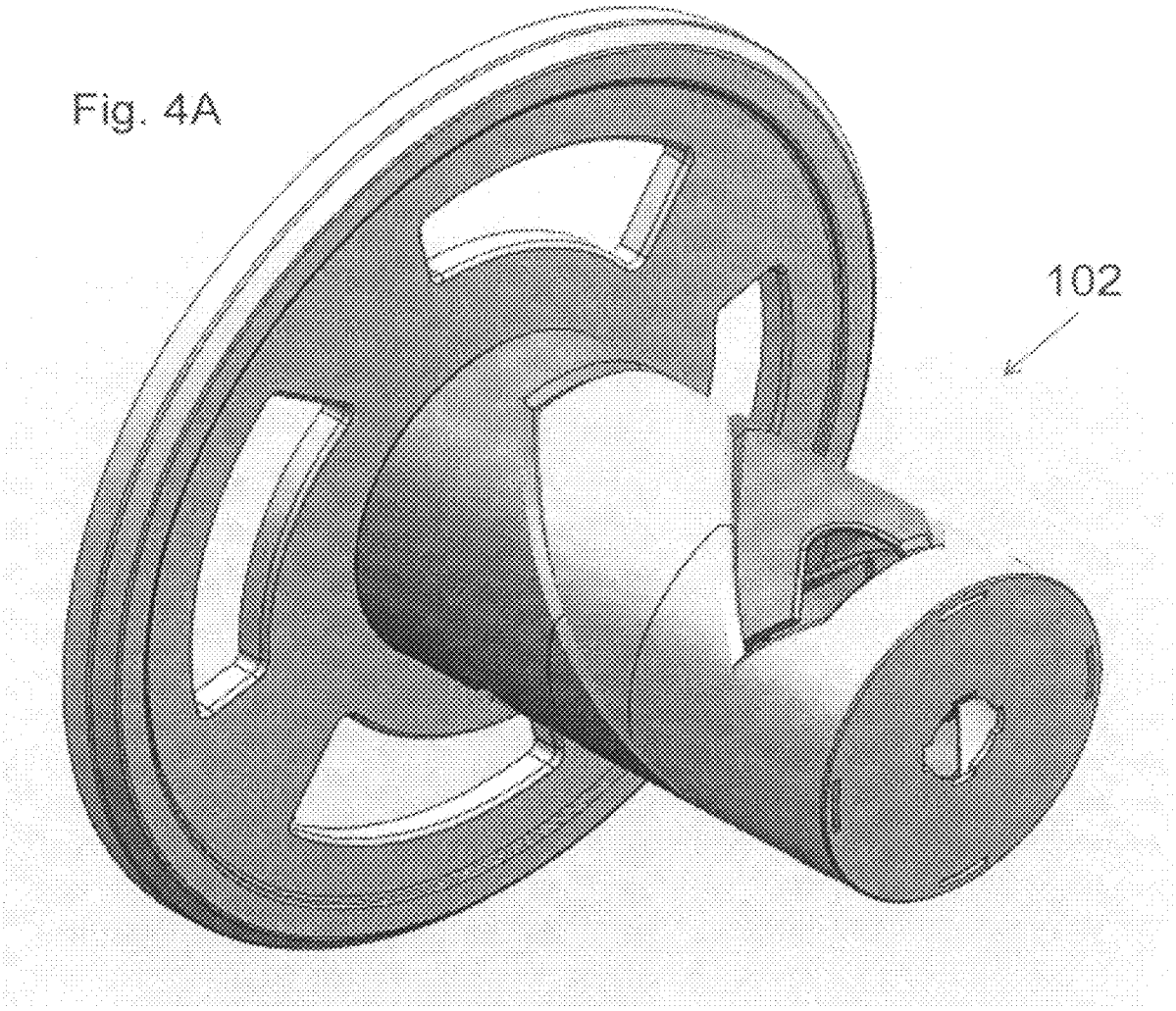
FIG. 4A is a schematic illustration of a portion of the spool of the hose reel in an unexpanded position, in accordance with the present invention.
Figure 4B:
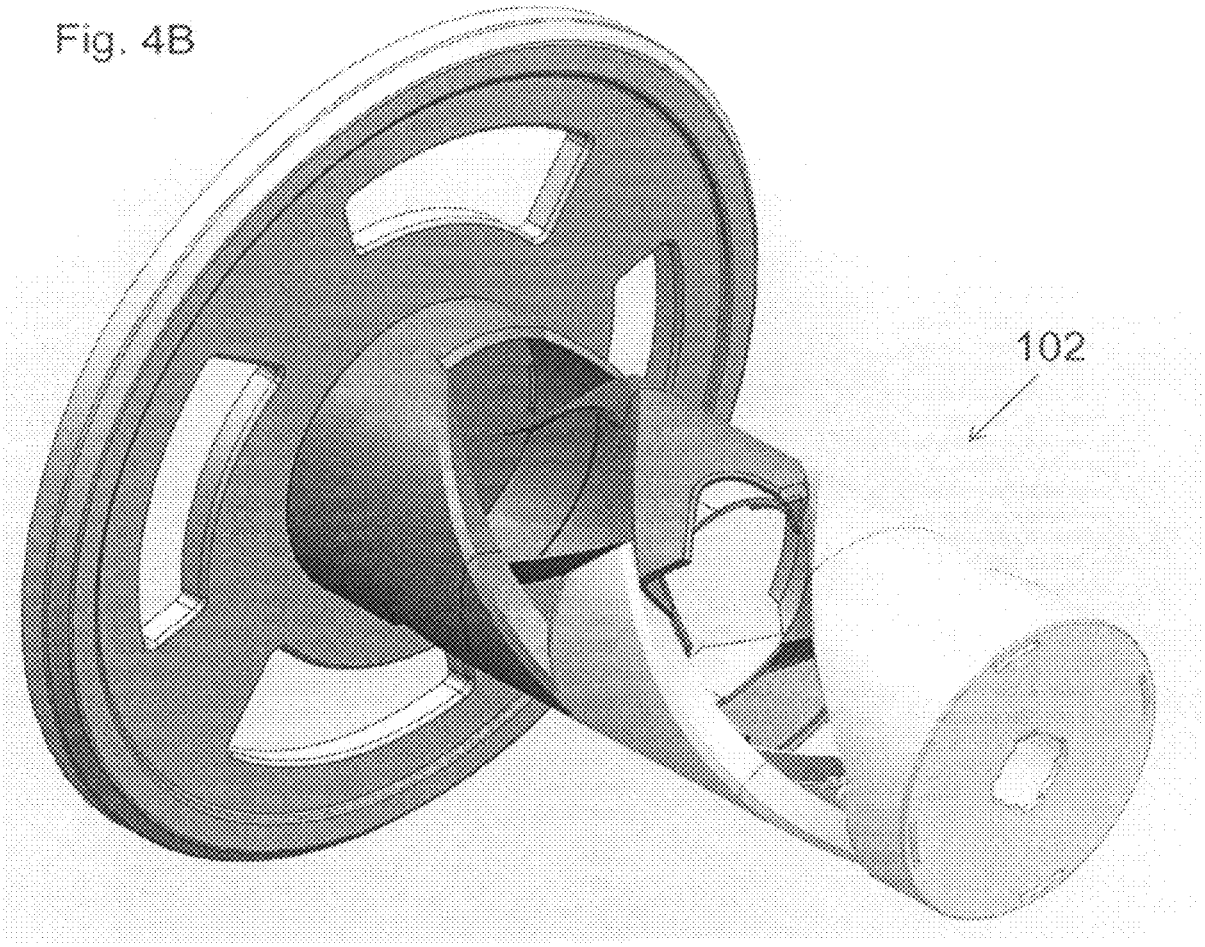
FIG. 4B is a schematic illustration of that portion of the spool in an expanded position, in accordance with the present invention.

Reference is made to FIG. 4A, which is a schematic illustration of a portion of the spool 102 in an unexpanded position; as well as to FIG. 4B, which is a schematic illustration of that portion of the spool 102 in an expanded position, in accordance with the present invention.

Figure 5A:
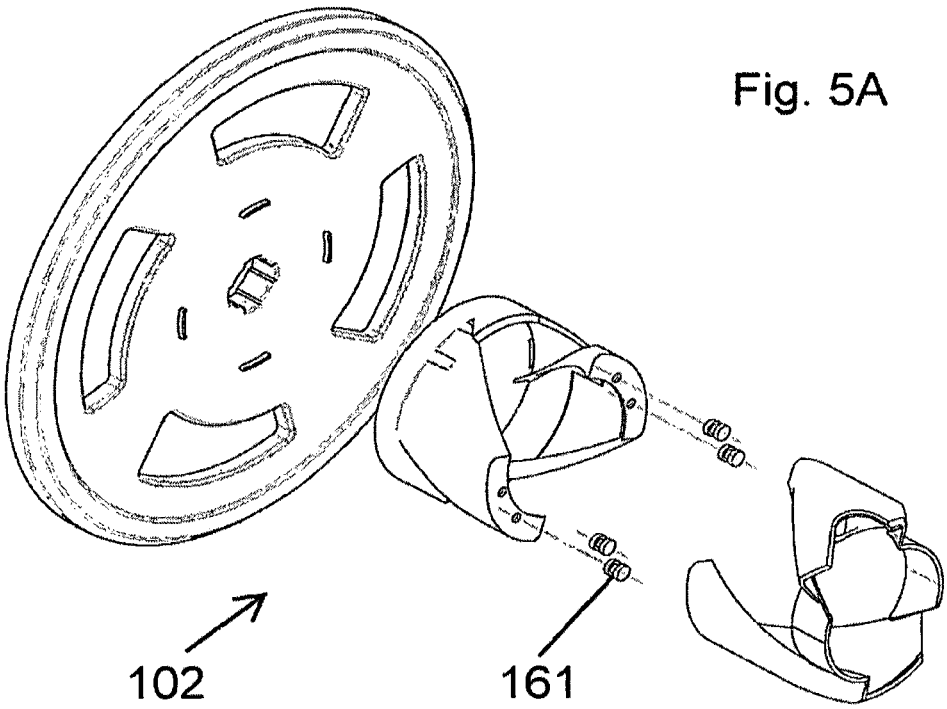
FIGS. 5A and 5B are additional schematic illustrations of exploded views of the spool of the hose reel, in accordance with the present invention.
Figure 5B:
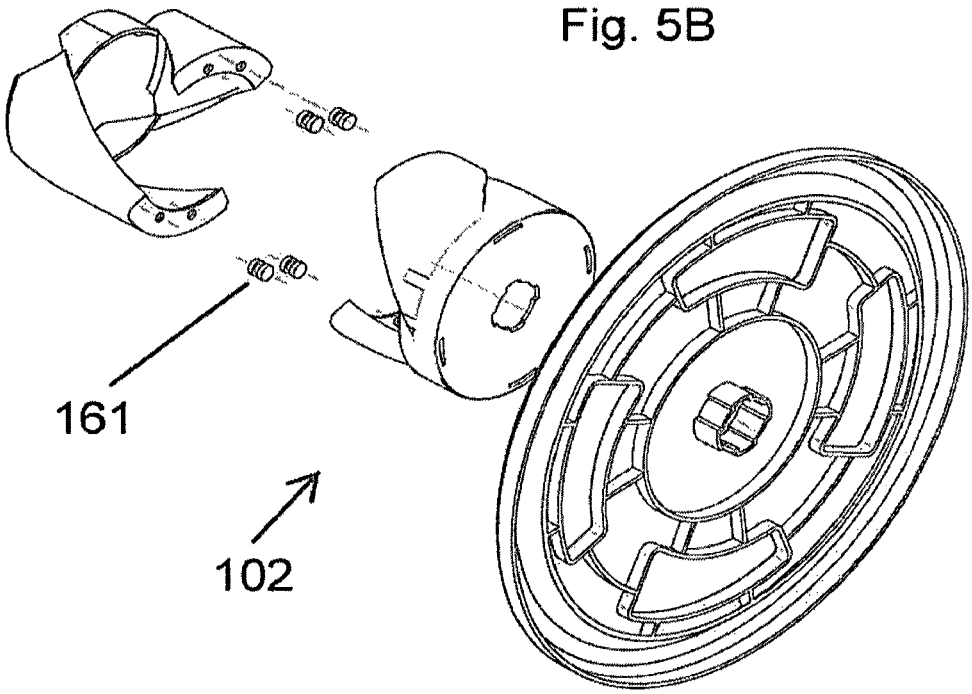

Reference is made to FIGS. 5A and 5B, which are additional schematic illustrations of exploded views of the spool 102 in accordance with the present invention. FIGS. 5A and 5B show in greater detail some of the components of spool 102, including the connecting elements 161 (e.g., nuts, bolts, screws, nails, bonding elements) which may connect adjacent sub-units of spool 102.

Figure 6A:
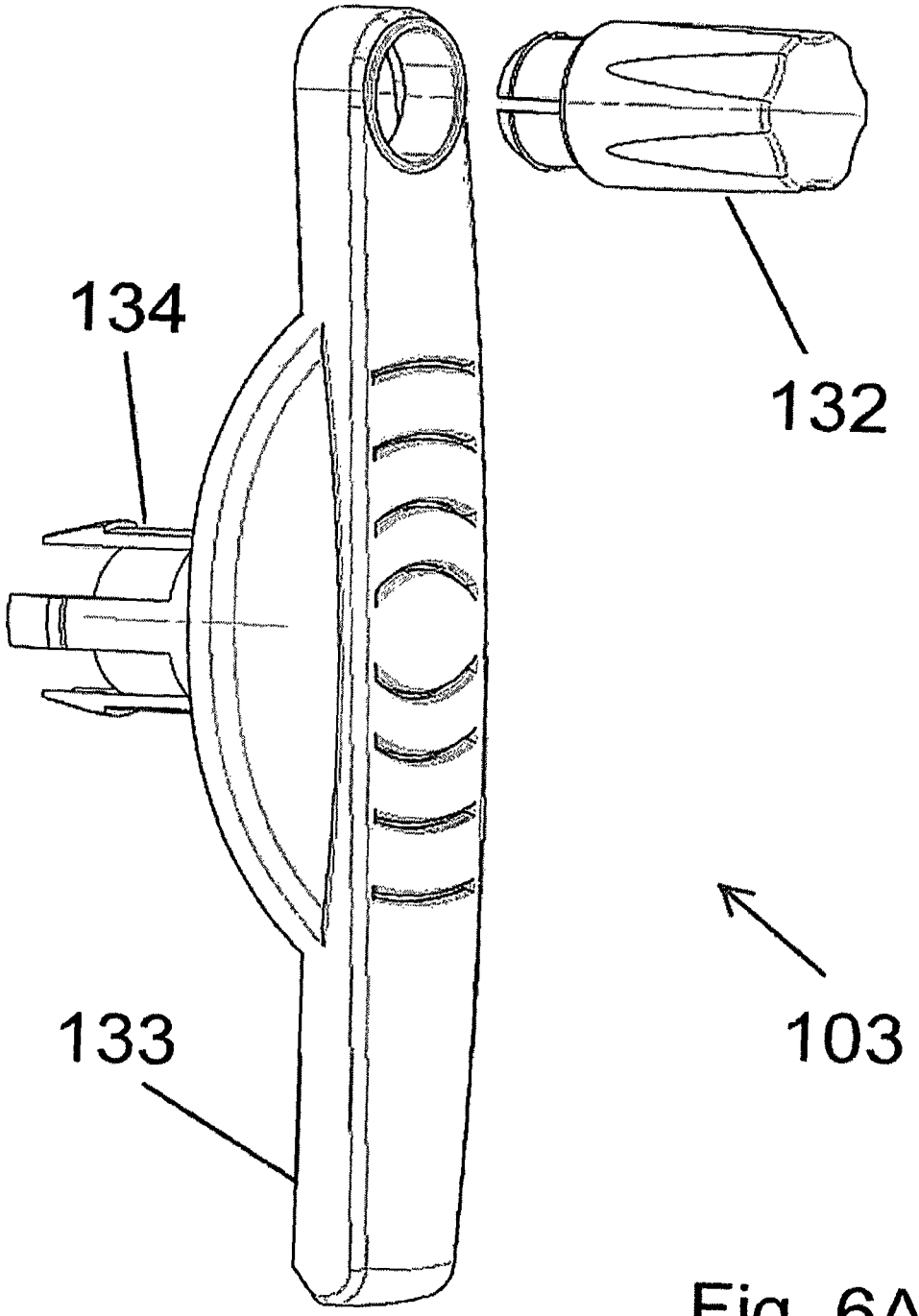
FIGS. 6A, 6B and 6C are schematic illustrations of a handle of the hose reel, in accordance with the present invention.
Figure 6B:
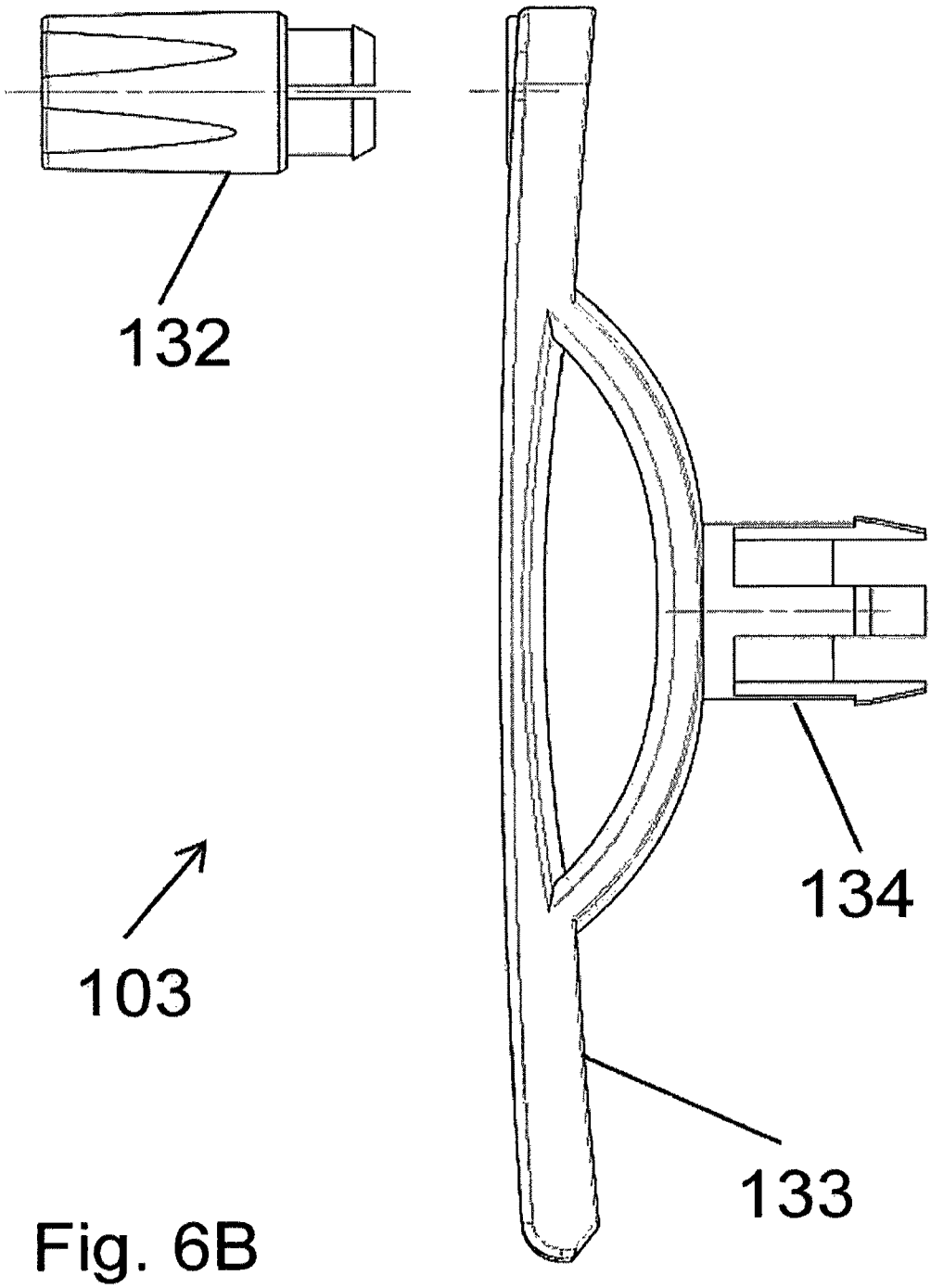
Figure 6C:
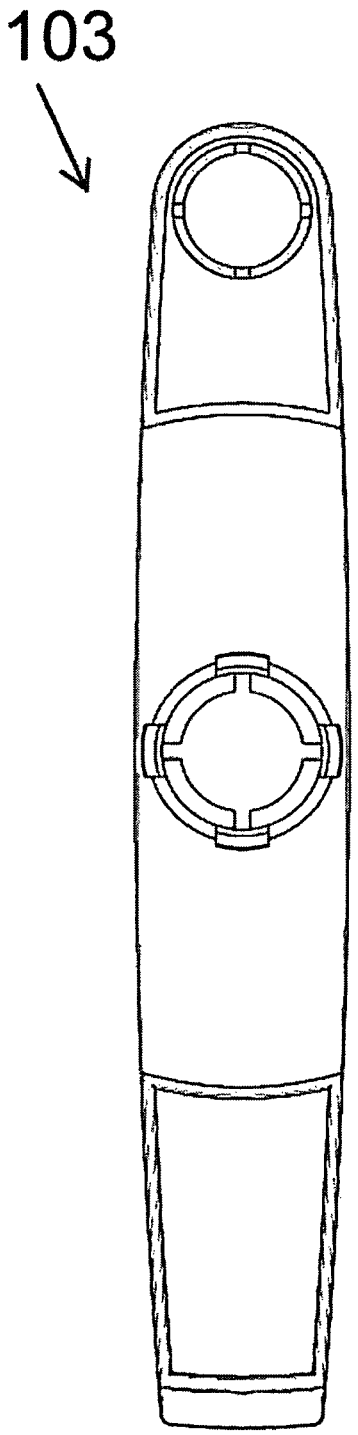

Reference is made to FIGS. 6A, 6B and 6C, which are schematic illustrations of the handle 103 in accordance with the present invention. FIGS. 6A, 6B and 6C show in greater details the components of the handle 103, including the crank 132 and the handle base 133, as well as a connecting element 134 which may connect the handle 103 to the spool 102.

Figure 7:
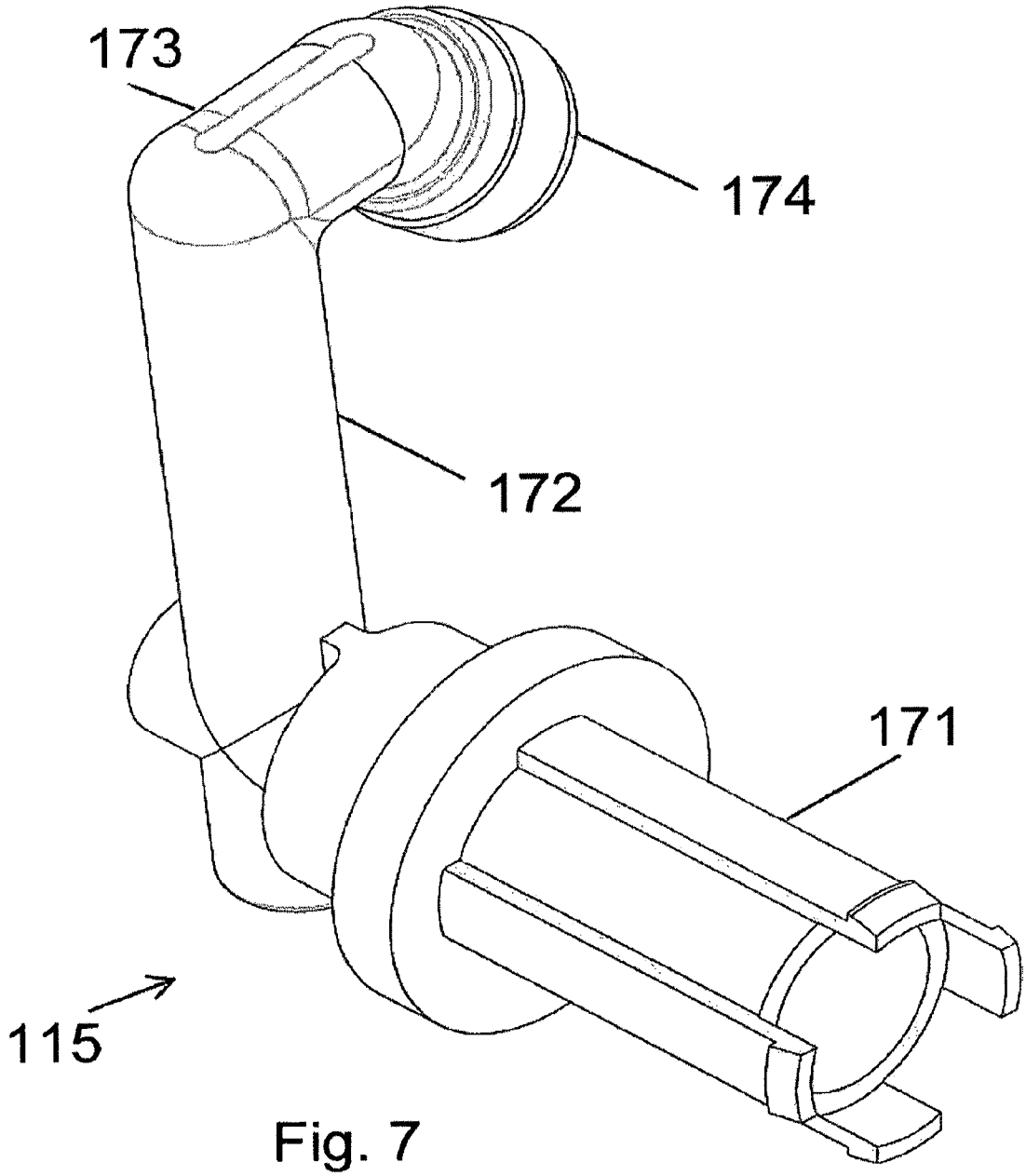
FIG. 7 is a schematic illustration of a hose connector of the hose reel, in accordance with the present invention.

Reference is made to FIG. 7, which is a schematic illustration of hose connector 115 in accordance with the present invention. The hose connector 115 may be part of the spool 102, or may be attached or coupled to the spool 102, or may be otherwise associated with spool 102 or embedded therein or connected thereto. For example, a first tube 171 may be generally parallel to the spool 102, or may be inserted within the spool 102 or may be embedded within the spool 102. A second tube 172 may be generally perpendicular to the first tube 171 and/or to the spool 102, and may protrude out of the spool 102. A third tube 173 may be connected to the second tube 172; the third tube 173 may be general perpendicular to the second tube 172, and/or may be generally perpendicular to the first tube 171. The third tube 173 may end with a connector ending 174 which may be adapted to be coupled to a flexible hose, for example, by utilizing a threading or screwing mechanism, or by using a male-female type of connection, or by other suitable types of connections.

Figure 8:
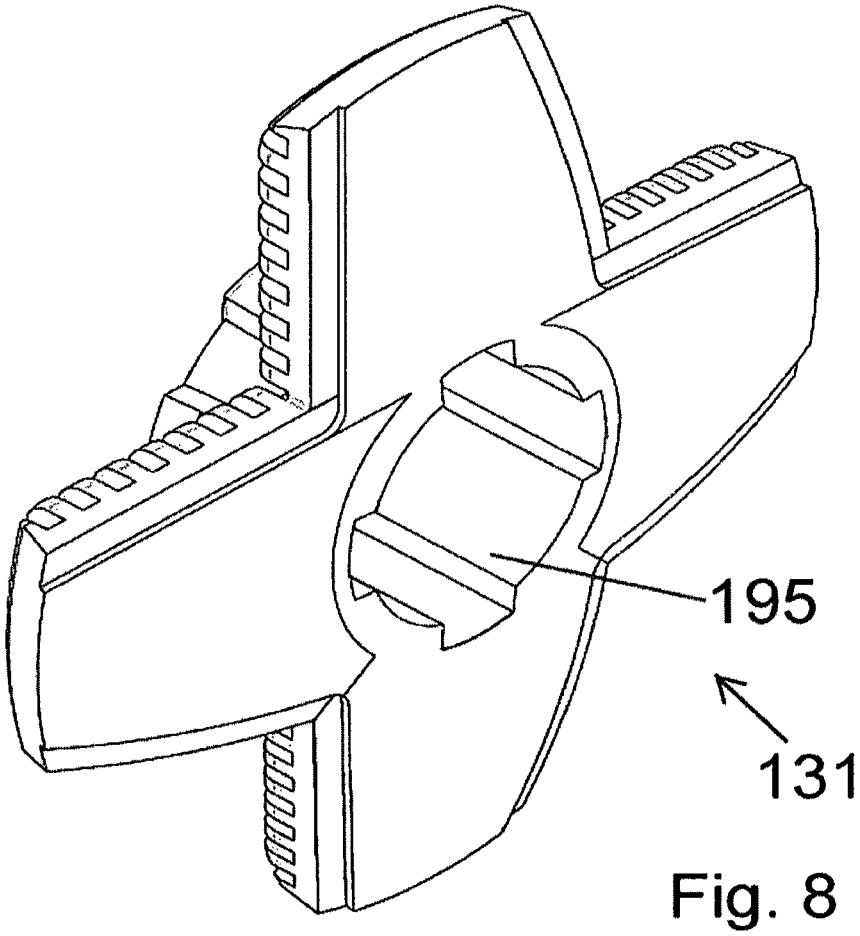
FIG. 8 is a schematic illustration of the cross-shaped terminator which may fit on an ending of the spool of the hose reel, in accordance with the present invention.

Reference is made to FIG. 8, which is a schematic illustration of the cross-shaped terminator 131 which may fit on a first end of the spool 102, opposite to a second end of the spool 102 on which the handle 103 may be connected. The cross-shaped terminator 131 may optionally include an aperture or adapter 195 able to be detachably connected to a flexible hose (e.g., a short flexible hose), in order to allow transfer of water or liquid(s) from such shorter flexible hose, through the adapter 195, through the spool 102, through the hose connector 115, to the flexible hose 199.

Figure 9:
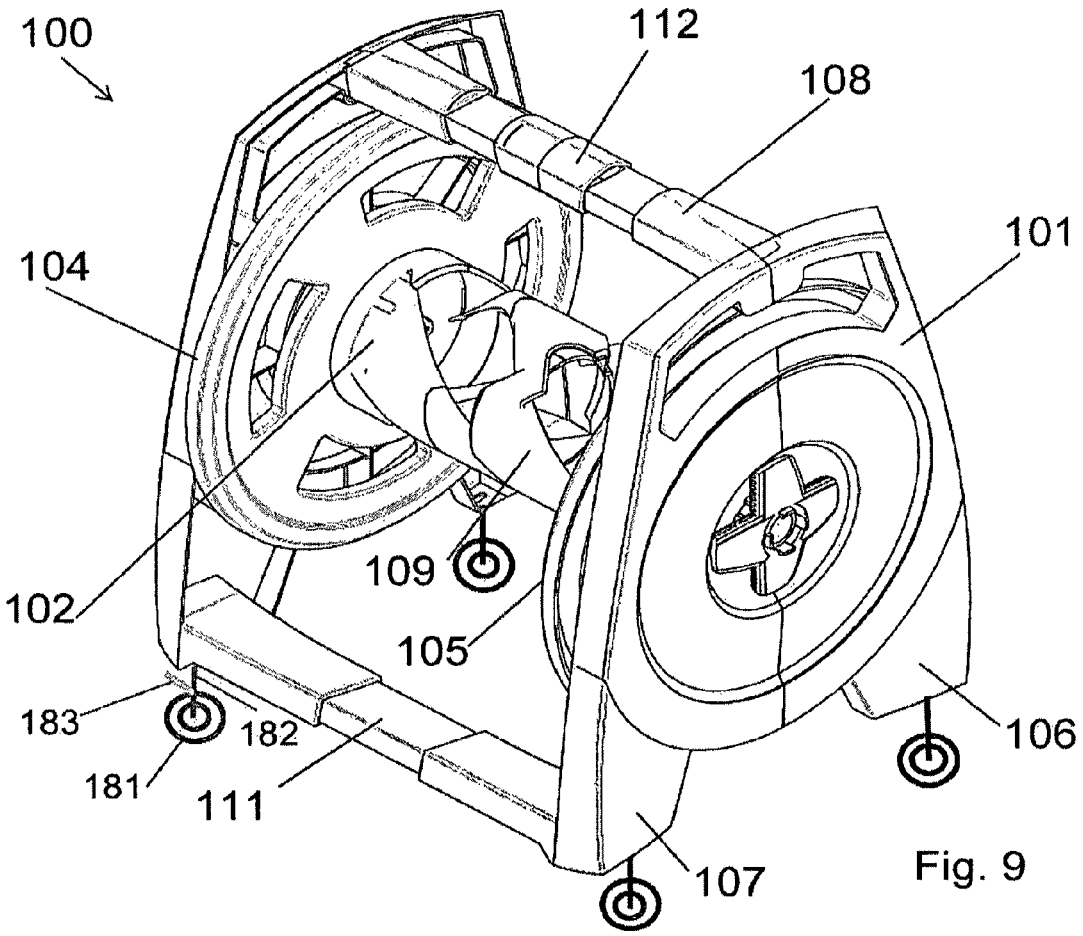
FIG. 9 is a schematic illustration of the hose reel implemented with a set of four wheels, in accordance with the present invention.

Reference is made to FIG. 9, which is a schematic illustration of the hose reel 100 implemented with a set of four wheels 181, in accordance with the present invention. Other suitable number of wheels 181 may be used. Optionally, each one of wheels 181 may be suspended through a small rod or caster 182, such that each one of wheels 181 may be free to rotate and also to swivel. Optionally, one or some or all of the wheels 181 may have a locking mechanism 183, allowing a user to lock the wheel(s) 181 and to block it (or them) from rotating and/or swiveling.

Figure 10:
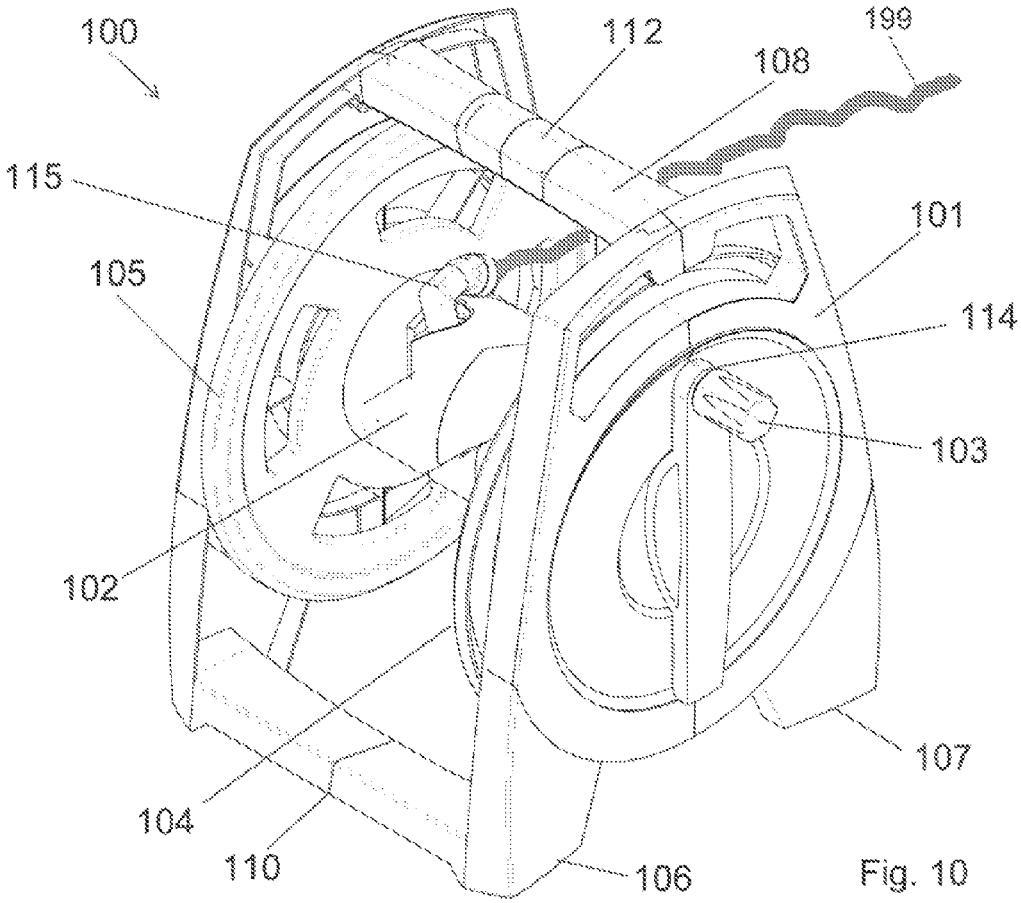
FIG. 10 is a schematic illustration of the hose reel having a flexible hose connected thereto, in accordance with the present invention.

Reference is made to FIG. 10, which is a schematic illustration of the hose reel 100 having the flexible hose 199 connected thereto, in accordance with the present invention. The hose reel 100 may be provided by a manufacturer or a distributor, for example, without also providing the flexible hose 199; or, together with providing the flexible hose 199 but with the flexible hose being detached from the hose reel 100; or, together with the flexible hose 199 being attached to the hose reel 100.

Figure 11A:
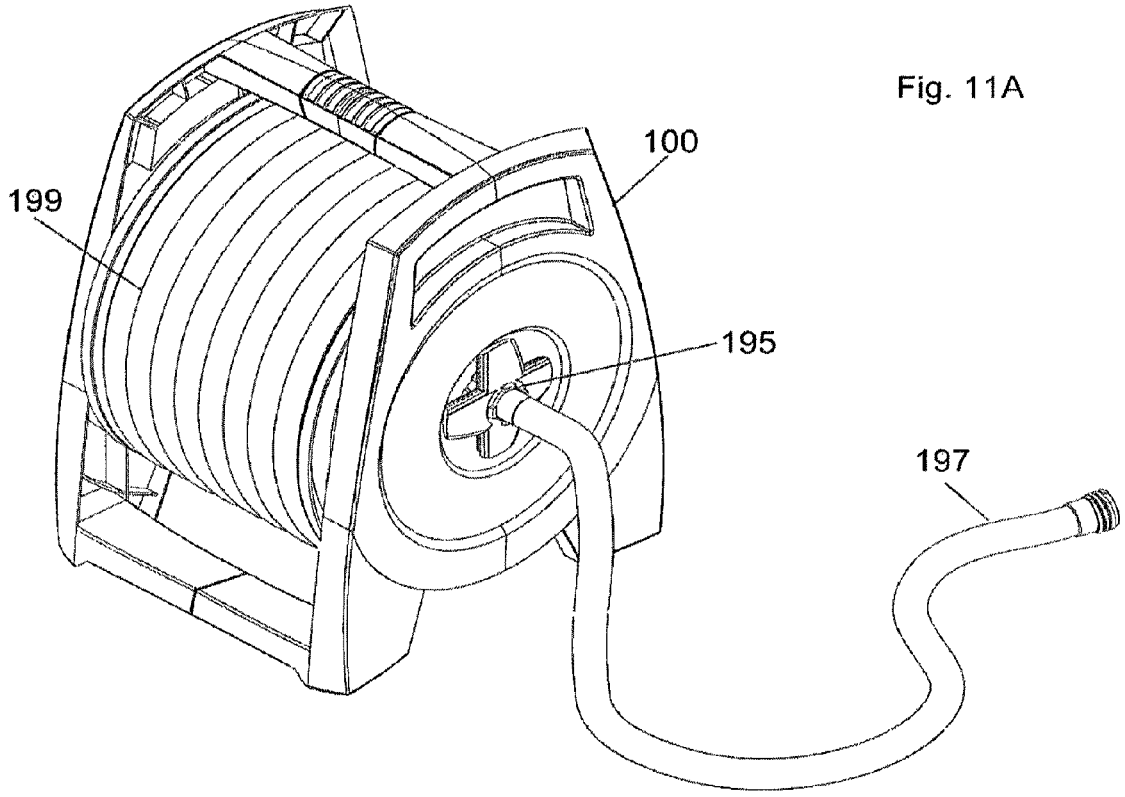
FIGS. 11A and 11B are schematic illustrations of two views of the hose reel 100 in a narrow or unexpanded position, having the flexible hose coiled around it, in accordance with the present invention.
Figure 11B:
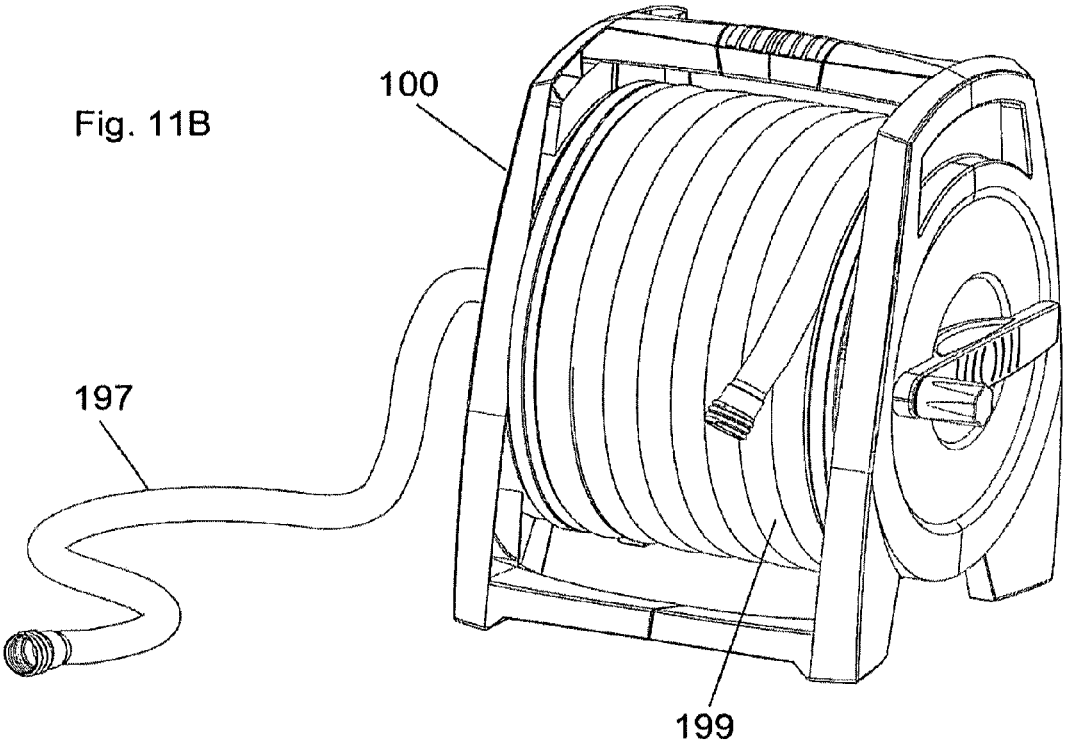

Reference is made to FIGS. 11A and 11B, which are schematic illustrations of two views of the hose reel 100 in a narrow or unexpanded position, having flexible hose 199 coiled around it. Optionally, a second flexible hose 197 may be connected to the adapter 195 of the hose reel 100. The length of the flexible hose 199 may be relatively short, such that it may coil around the spool 102 without expanding the width of the hose reel 100.

Figure 12A:
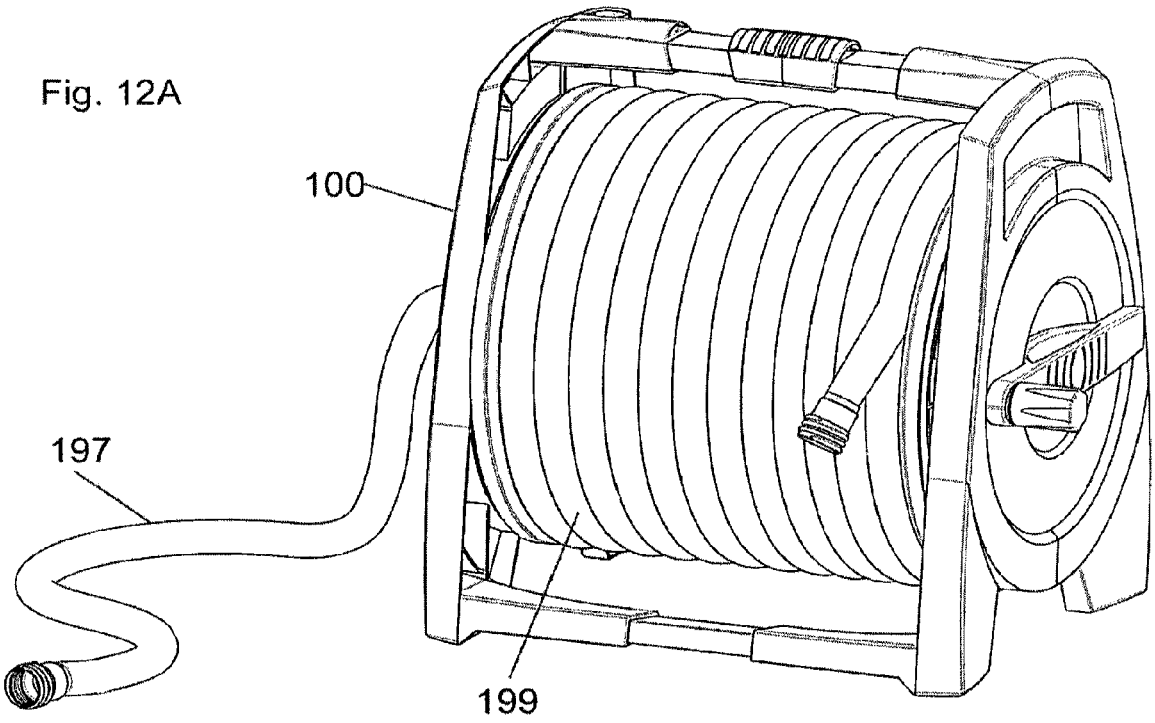
FIGS. 12A, 12B and 12C are schematic illustrations of three views of the hose reel in an expanded position, having the flexible hose coiled around it, in accordance with the present invention.
Figure 12B:
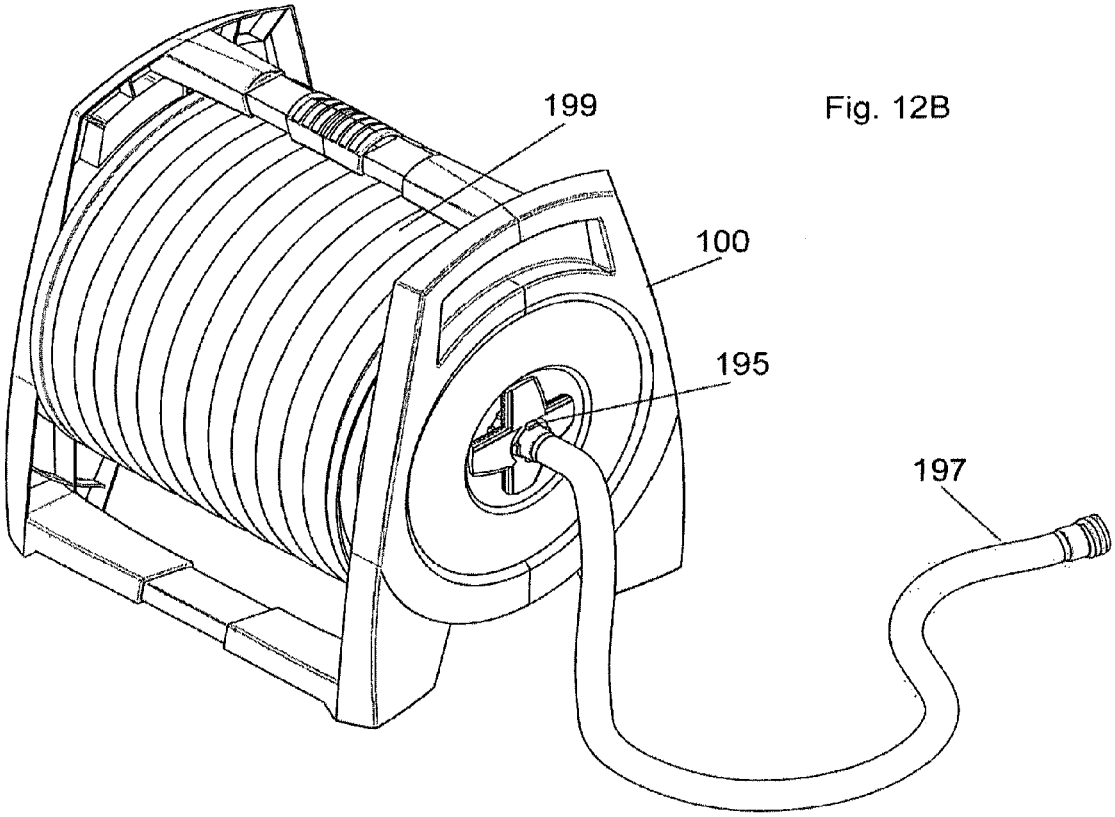
Figure 12C:
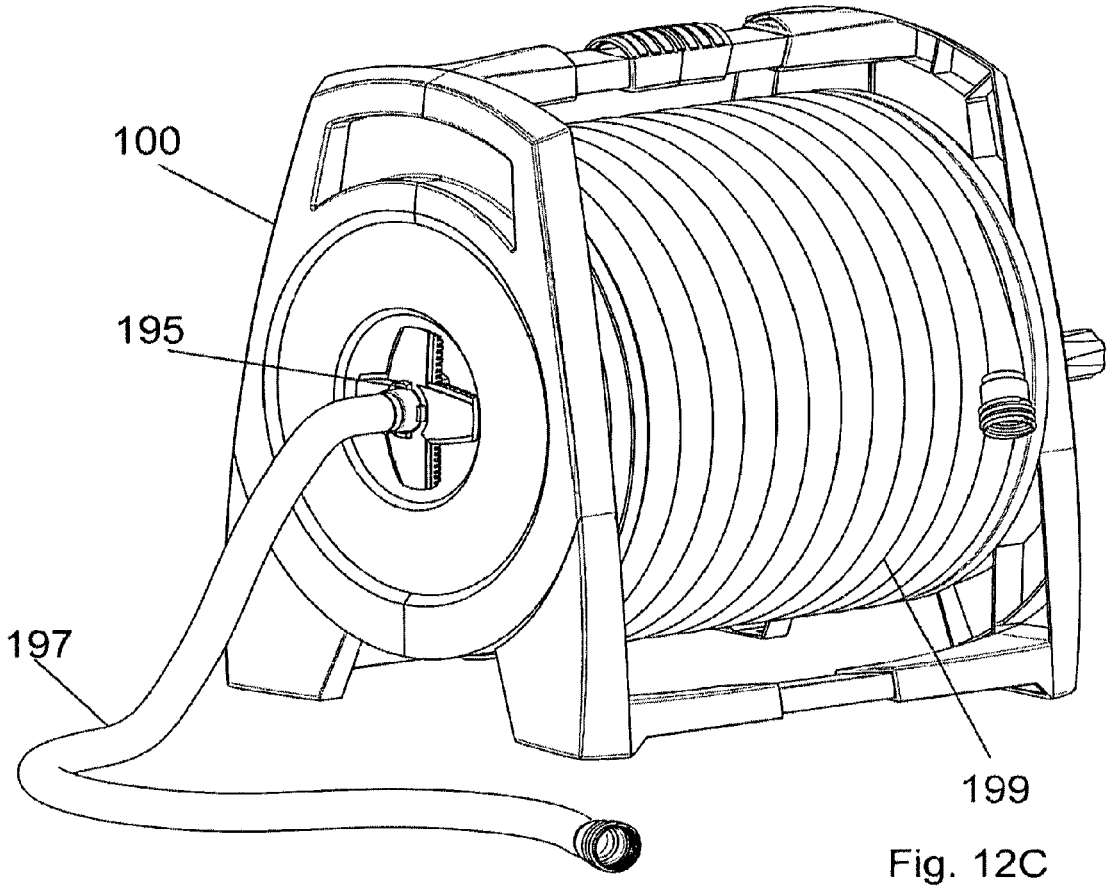

Reference is made to FIGS. 12A, 12B and 12C, which are schematic illustrations of three views of the hose reel 100 in an expanded position, having flexible hose 199 coiled around it. Optionally, a second flexible hose 197 may be connected to the adapter 195 of the hose reel 100. The length of the flexible hose 199 may be relatively long, such that it may coil around the spool 102 while expanding the width of the hose reel 100.

Although portions of the discussion herein may relate, for demonstrative purposes, to a hose reel which may be manually operated by a user who may rotate a handle, the present invention may further be used in conjunction with an automatic or semi-automatic hose reel which may utilize electric power or other suitable types of mechanisms (e.g., hydraulic mechanism, spring-based mechanism, or the like) for winding and/or releasing a flexible hose. For example, an electrical hose reel may be equipped with a motor able to receive power from a power source (e.g., an internal battery, or an electric socket), and able to rotate the spool 102 in a first rotational direction to wind the flexible hose 199 and/or in a second rotational direction to release or stretch the flexible hose 199. Upon such automatic rotation, as the width or volume of the flexible hose 199 within the housing 101 increase or decrease, one or more of the expansion mechanisms 109-112 may expand or shrink, respectively. Optionally, an electric expansion mechanism may be utilized in one or more of the expansion mechanisms 109-112 described herein. Optionally, the expansion and/or narrowing of the hose reel 100 may be performed substantially automatically by an electric motor or other suitable components, for example, in response to a user command to expand or shrink (e.g., the user may press an "expand" button or a "shrink" button" within the hose reel 100).

The present invention may be implemented, for example, as a hose reel cart or as a hose reel having supporting wheels, thereby allowing a user to more easily push or move the hose reel by taking advantage of such wheels.

The hose reel 100 may be formed of plastic; or, one or more components may be formed of plastic. Optionally, one or more of the components of hose reel 100 may be formed of injection molding of one or more raw plastic material(s). The present invention may be exercised using other suitable materials, for example, wood, metal(s), or the like; and/or using plastic components which may be formed by injection molding or by other plastic manufacturing processes. For example, a hose reel may be formed or assembled such that substantially all the components of the hold reel, in accordance with the present invention, may be formed or plastic, or injected plastic material(s), or wood, or metal, or the like. Optionally, at least the spool and/or one or more of the expansion mechanism(s) of the hose reel, may be formed or plastic, or injected plastic material(s), or wood, or metal, or the like. Other suitable material(s) or combinations of materials may be used.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments of the present invention have been illustrated and described herein, many modifications, substitutions, changes, and equivalents may occur to those skilled in the art. Accordingly, the claims are intended to cover all such modifications, substitutions, changes, and equivalents.

What is claimed is:

1. A hose reel comprising:

a housing (101) comprising (a) a first horizontal leg member (106), (b) a second horizontal leg member (107), and (c) a top member (108);

a spool (102) rotatably disposed within the housing (101), wherein the spool (102) is adapted to connect to a flexible hose (199);

wherein the top member (108) comprises an upper expansion mechanism (112) to modify a length of the top member (108);

wherein the first horizontal leg member (106) comprises a first leg expansion mechanism (110) to modify a length of the first horizontal leg member (106);

wherein the second horizontal leg member (107) comprises a second leg expansion mechanism (111) to modify a length of the second horizontal leg member (107);

wherein the spool (102) comprises a spool expansion mechanism (109) to modify a length of the spool (102);

a single-handle winding mechanism comprising a single handle (103) to rotate the spool so as to coil the flexible hose (199) around the spool (102), wherein coiling of the flexible hose (199) gradually expands said expansion mechanisms (109, 110, 111, 112) in response to gradual increase in volume of the flexible hose (199) being coiled around the spool (102).

2. The hose reel of claim 1, wherein each one of the first leg expansion mechanism (110), the second leg expansion mechanism (111), and the upper expansion mechanism (112) comprises a telescopic mechanism having two or more nested elements.

3. The hose reel of claim 2, wherein the spool expansion mechanism (109) is to stretch in length upon application of a pull force which pulls the single handle (103) in an outwardly direction away from the spool (102).

4. The hose reel of claim 1, wherein said expansion mechanisms (109, 110, 111, 112) are to expand a width of the housing (101) in response to an increase in volume of the flexible hose (199) coiled around the spool (102).

5. The hose reel of claim 1, wherein the housing (101) comprises a support frame defined by first and second sides; wherein the expansion mechanism is to increase a distance between the first and second sides of the support frame in response to a pulling of said single handle (103) in an outwardly direction away from the spool (102).

6. The hose reel of claim 1, wherein the spool (102) comprises a connector to detachably attach the flexible hose (199) to the spool (102).

7. The hose reel of claim 6, wherein the connector comprises:

a first tube (171) generally parallel to the spool (102);

a second tube (172) generally perpendicular to the first tube (171);

a third tube (173) which is both (A) generally perpendicular to the second tube (172) and (B) generally perpendicular to the first tube (171);

a connector ending (174) connected to said third tube (173).

8. The hose reel of claim 1, wherein a lower part of the hose reel comprises two or more wheels to allow manual wheeling of the hose reel.

9. The hose reel of claim 1, wherein the single handle (103) is a fixed non-folding handle.

10. The hose reel of claim 1, wherein the single handle (103) is a multiple-position handle able to pivot from a raised position to a lowered position.

11. The hose reel of claim 1, further comprising an electric motor to rotate the spool (102).

12. The hose reel of claim 1, wherein a width of the housing is modifiable in response to rotation of said single handle (103).

13. The hose reel of claim 1, wherein at least the spool and all the expansion mechanisms (109, 110, 111, 112) are formed of plastic.

14. The hose reel of claim 1, wherein at least the spool and all the expansion mechanisms (109, 110, 111, 112) are formed of one or more injected plastic materials.

15. The hose reel of claim 1, wherein substantially all components of the hose reel are formed of plastic.

16. The hose reel of claim 1, wherein substantially all components of the hose reel are formed of one or more injected plastic materials.

17. The hose reel of claim 1, further comprising said flexible hose, wherein the flexible hose is detachably attached to the spool.

18. The hose reel of claim 1, wherein the spool (102) comprises at least two sub-units (121, 122).

19. The hose reel of claim 1, further comprising:

a cross-shaped terminator (131) connected between a first end of the spool (102), wherein the first end of the spool (102) is opposite to a second end of the spool (102) which is connected to said single handle (103).

20. The hose reel of claim 19, wherein the cross-shaped terminator (131) comprises an adapter (195) to detachably connect to a secondary hose (197).

21. The hose reel of claim 20, wherein the adapter (195) allows transfer of a liquid from said secondary hose (197), through said adapter (195), through said spool (102), through a hose connector (115), to said flexible hose (199).

* * * * *